US009404379B2

(12) United States Patent
Mishra

(10) Patent No.: US 9,404,379 B2
(45) Date of Patent: Aug. 2, 2016

(54) GAS TURBINE SHROUD ASSEMBLIES

(71) Applicant: General Electric Company, Schenectady, NY (US)

(72) Inventor: Niraj K. Mishra, Bangalore (IN)

(73) Assignee: General Electric Company, Schenectady, NY (US)

( * ) Notice: Subject to any disclaimer, the term of this patent is extended or adjusted under 35 U.S.C. 154(b) by 572 days.

(21) Appl. No.: 13/855,218

(22) Filed: Apr. 2, 2013

(65) Prior Publication Data

US 2014/0294560 A1 Oct. 2, 2014

(51) Int. Cl.
*F04D 31/00* (2006.01)
*F01D 11/24* (2006.01)

(52) U.S. Cl.
CPC ..... *F01D 11/24* (2013.01); *F05D 2240/10* (2013.01); *F05D 2240/11* (2013.01); *F05D 2250/141* (2013.01); *F05D 2250/181* (2013.01); *F05D 2250/182* (2013.01); *F05D 2250/294* (2013.01); *F05D 2260/201* (2013.01); *F05D 2260/202* (2013.01); *F05D 2260/205* (2013.01)

(58) Field of Classification Search
CPC ..... F01D 11/24; F01D 25/12; F05D 2240/10; F05D 2240/11; F05D 2250/141; F05D 2250/181; F05D 2250/182; F05D 2250/294; F05D 2260/201; F05D 2260/202; F05D 2260/205
USPC ..... 415/116, 115, 1, 175
See application file for complete search history.

(56) References Cited

U.S. PATENT DOCUMENTS

| | | | | |
|---|---|---|---|---|
| 6,390,769 | B1 * | 5/2002 | Burdgick et al. | 415/116 |
| 2005/0232752 | A1 | 10/2005 | Meisels | |
| 2005/0281663 | A1 * | 12/2005 | Trindade et al. | 415/1 |

* cited by examiner

*Primary Examiner* — Thomas Denion
*Assistant Examiner* — Kelsey Stanek
(74) *Attorney, Agent, or Firm* — Sutherland Asbill & Brennan LLP

(57) ABSTRACT

Embodiments of the present disclosure include a gas turbine shroud assembly. The shroud assembly may include a shroud structure that defines a first cooling chamber and a second cooling chamber. The shroud assembly may also include a first impingement plate disposed within the first cooling chamber and a second impingement plate disposed within the second cooling chamber. Further, the shroud assembly may include one or more cooling channels formed within the shroud structure. The cooling channels may be configured to connect the first cooling chamber with the second cooling chamber. The shroud assembly may also include a flow of cooling air in communication with the first cooling chamber. In this manner, the flow of cooling air may flow from the first cooling chamber to the second cooling chamber by way of the one or more cooling channels.

17 Claims, 4 Drawing Sheets

GAS TURBINE SHROUD ASSEMBLIES

FIELD OF THE DISCLOSURE

Embodiments of the disclosure relate generally to gas turbine engines and more particularly to gas turbine shroud assemblies.

BACKGROUND OF THE DISCLOSURE

Gas turbines are widely used in industrial and commercial operations. A typical gas turbine includes a compressor at the front, one or more combustors around the middle, and a turbine at the rear. The compressor imparts kinetic energy to the working fluid (e.g., air) to produce a compressed working fluid at a highly energized state. The compressed working fluid exits the compressor and flows to the combustors where it mixes with fuel and ignites to generate combustion gases having a high temperature and pressure. The hot combustion gases flow to the turbine where they expand to produce work. Consequently, the turbine is exposed to very high temperatures due to the hot combustion gases. As a result, the various turbine components, such as the turbine shrouds, typically need to be cooled. Accordingly, there is a need to provide improved shroud cooling systems and methods.

BRIEF DESCRIPTION OF THE DISCLOSURE

Some or all of the above needs and/or problems may be addressed by certain embodiments of the present disclosure. According to one embodiment, there is disclosed a gas turbine shroud assembly. The assembly may include a shroud structure that defines a first cooling chamber and a second cooling chamber. The assembly may also include a first impingement plate disposed within the first cooling chamber and a second impingement plate disposed within the second cooling chamber. Further, the assembly may include one or more cooling channels formed within the shroud structure. The cooling channels may be configured to connect the first cooling chamber with the second cooling chamber. The assembly may also include a flow of cooling air in communication with the first cooling chamber. In this manner, the flow of cooling air may flow from the first cooling chamber to the second cooling chamber by way of the one or more cooling channels.

According to another embodiment, there is disclosed a method. The method may include flowing cooling air into a first cooling chamber defined within a shroud structure. The method may also include flowing the cooling air through a first impingement plate disposed within the first cooling chamber so as to increase the velocity of the flow of cooling air to increase the heat transfer coefficient within the first cooling chamber. Further, the method may include flowing the cooling air through one or more cooling channels formed within the shroud structure to a second cooling chamber defined within the shroud structure. The method may also include flowing the cooling air through a second impingement plate disposed within the second cooling chamber so as to increase the velocity of the flow of cooling air to increase the heat transfer coefficient within the second cooling chamber.

Further, according to another embodiment, there is disclosed a gas turbine assembly. The gas turbine assembly may include a rotating blade assembly. The gas turbine assembly may also include a shroud structure positioned about the rotating blade assembly. The shroud structure may define a first cooling chamber and a second cooling chamber. A first impingement plate may be disposed within the first cooling chamber, and a second impingement plate may be disposed within the second cooling chamber. The gas turbine assembly may also include one or more cooling channels formed within the shroud structure. The cooling channels may be configured to connect the first cooling chamber with the second cooling chamber. Further, the gas turbine assembly may include a flow of cooling air in communication with the first cooling chamber. The flow of cooling air may flow from the first cooling chamber to the second cooling chamber by way of the one or more cooling channels.

Other embodiments, aspects, and features of the invention will become apparent to those skilled in the art from the following detailed description, the accompanying drawings, and the appended claims.

BRIEF DESCRIPTION OF THE DRAWINGS

Reference will now be made to the accompanying drawings, which are not necessarily drawn to scale, and wherein.

DETAILED DESCRIPTION OF THE DISCLOSURE

Illustrative embodiments will now be described more fully hereinafter with reference to the accompanying drawings, in which some, but not all embodiments are shown. The present disclosure may be embodied in many different forms and should not be construed as limited to the embodiments set forth herein. Like numbers refer to like elements throughout.

Figure 1:
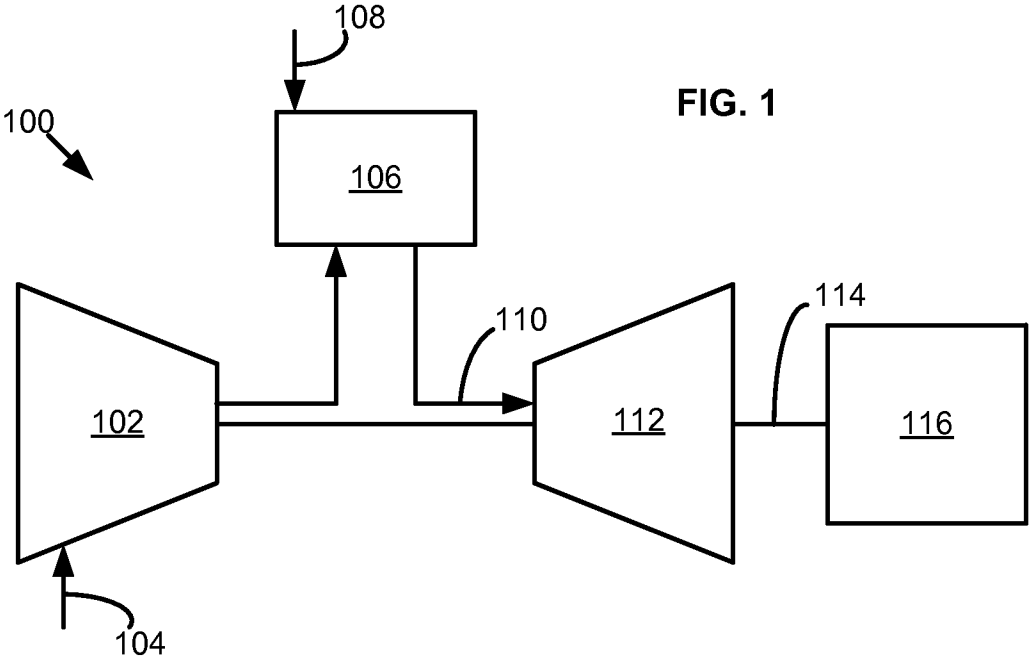
FIG. 1 is an example schematic view of a gas turbine engine, according to an embodiment of the disclosure.

Illustrative embodiments are directed to, among other things, gas turbine shroud assemblies. For example, FIG. 1 depicts an example schematic view of a gas turbine assembly 100 as may be used herein. The gas turbine assembly 100 may include a gas turbine having a compressor 102. The compressor 102 may compress an incoming flow of air 104. The compressor 102 may deliver the compressed flow of air 104 to a combustor 106. The combustor 106 may mix the compressed flow of air 104 with a pressurized flow of fuel 108 and ignite the mixture to create a flow of combustion gases 110. Although only a single combustor 106 is shown, the gas turbine engine may include any number of combustors 106. The flow of combustion gases 110 may be delivered to a turbine 112. The flow of combustion gases 110 may drive the turbine 112 so as to produce mechanical work. The mechanical work produced in the turbine 112 may drive the compressor 102 via a shaft 114 and an external load 116, such as an electrical generator or the like.

The gas turbine engine may use natural gas, various types of syngas, and/or other types of fuels. The gas turbine engine may be any one of a number of different gas turbine engines offered by General Electric Company of Schenectady, N.Y., including, but not limited to, those such as a 7 or a 9 series heavy duty gas turbine engine and the like. The gas turbine engine may have different configurations and may use other types of components. The gas turbine engine may be an aeroderivative gas turbine, an industrial gas turbine, or a reciprocating engine. Other types of gas turbine engines also may be used herein. Multiple gas turbine engines, other types of turbines, and other types of power generation equipment also may be used herein together.

Figure 2:
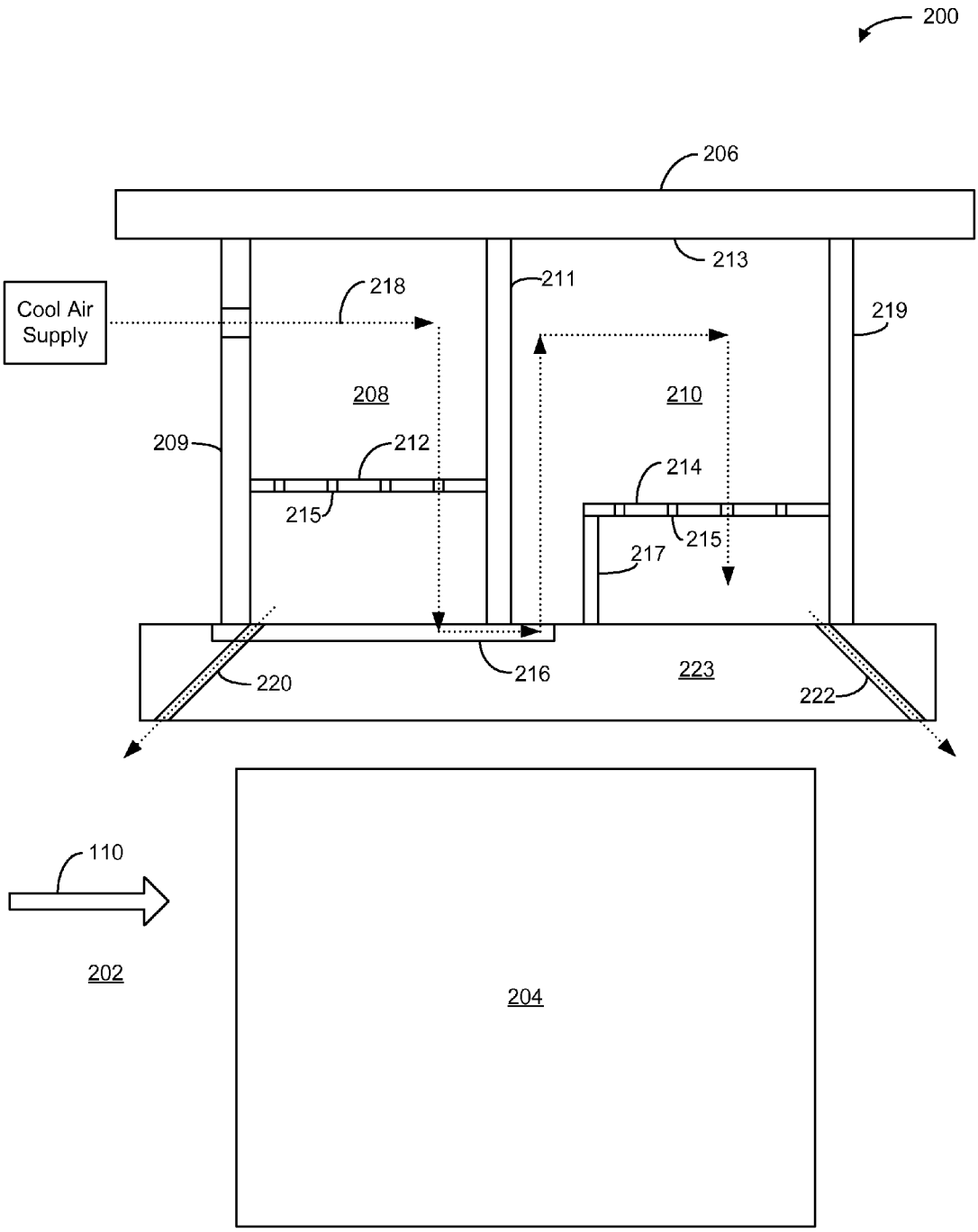
FIG. 2 is an example schematic cross-sectional view of a gas turbine shroud assembly, according to an embodiment of the disclosure.

In certain embodiments, as schematically depicted in FIG. 2, the turbine 112 may include a gas turbine shroud assembly 200. The shroud assembly 200 may form part of the turbine 112. For example, the shroud assembly 200 may define a hot gas path 202, in which the flow of combustion gases 110 travels. Moreover, the shroud assembly 200 may be positioned about a rotating blade 204 or the like. In this manner, the flow of combustion gases 110 may drive the rotating blade 204 to produce work. In some instances, as discussed in greater detail below, the shroud assembly 200 may be cooled by a flow of cooling air from the compressor 102 or elsewhere. That is, a flow of cooling air may at least partially flow throughout the shroud assembly 200. One or more shroud assemblies 200 may be positioned adjacent to one another. For example, the shroud assemblies 200 may be positioned circumferentially adjacent to one another about the rotating blade 204 so as to define a portion of the hot gas path 202.

As the combustion gases 110 travel along the hot gas path 202, at least a port of the combustion gases 110 may pass between the rotating blade 204 and the shroud assembly 200. As a result, the shroud assembly 200 may be heated by the combustion gases 110. In some instances, the leading edge of shroud assembly 200 may become hotter than the trailing edge of the shroud assembly 200. The systems and methods described herein are configured to cool the shroud assembly 200.

Still referring to FIG. 2, the shroud assembly 200 may include a shroud structure 206. In certain embodiments, the shroud structure 206 may be annular. The shroud structure 206 may include a single unitary structure or a number of structures formed together. Any number of shroud structures 206 may be used. For example, the shroud structure 206 may include an annular shroud support assembly and/or a shroud ring attached thereto.

The shroud structure 206 may define a first cooling chamber 208 and a second cooling chamber 210. That is, the various structural members of the shroud structure 206 may collectively define the first cooling chamber 208 and the second cooling chamber 210. For example, a first shroud wall 209, a second shroud wall 211, an outer shroud portion 213, and an inner portion 223 may define the first cooling chamber 208. Likewise, a third shroud wall 219, the second shroud wall 211, the outer shroud portion 213, and the inner portion 223 may define the second cooling chamber 210. With reference to the flow of hot combustion gases 110, the first cooling chamber 208 may be positioned upstream of the second cooling chamber 210. For example, the first cooling chamber 208 may be positioned about a leading edge of the blade 204, and the second cooling chamber 210 may be positioned about a trailing edge of the blade 204. The pressure within the first cooling chamber 208 may be greater than the pressure within the second cooling chamber 210. Any number of cooling chambers may be used herein.

The shroud assembly 200 may also include a first impingement plate 212 positioned within the first cooling chamber 208 and a second impingement plate 214 positioned within the second cooling chamber 210. In some instances, the first impingement plate 212 may be positioned between the first shroud wall 209 and the second shroud wall 211 within the first cooling chamber 208. In other instances, the second impingement plate 214 may be at least partially supported within the second cooling chamber 210 by a radially extending support member 217 and the third shroud wall 219. The first impingement plate 212 and the second impingement plate 214 may each include a number of holes 215 therein. In some instances, the holes 215 may include one or more variably sized holes. Moreover, the holes 215 within the first impingement plate 212 and the second impingement plate 214 may be the same size or a different size. That is, the holes 215 within the first impingement plate 212 may be a first size, and the holes 215 within the second impingement plate 214 may be a second size.

The shroud assembly 200 may also include one or more cooling channels 216 formed within the shroud structure 206. For example, the cooling channels 216 may be formed on a surface of the inner shroud portion 223 of the shroud structure 206. The cooling channels 216 may extend axially between the first cooling chamber 208 to the second cooling chamber 210. In this manner, the cooling channels 216 may be configured to connect the first cooling chamber 208 with the second cooling chamber 210. The cooling channels 216 may be configured to cool the inner portion 223. For example, the cooling channels 216 may extend along the leading edge of the inner portion 223, which may be hotter than the trailing edge of the inner portion 223. In this manner, the cooling channels 216 may cool the leading edge of the inner portion 223.

The first cooling chamber 208, the cooling channels 216, and the second cooling chamber 210 may collectively define a flow path. For example, as indicated by the dotted lines, the shroud assembly 200 may include a flow of cooling air 218 therethrough. In some instances, the flow of cooling air 218 may be a secondary flow of air supplied by the compressor 102. However, other sources of cooling air 218 may also be used herein.

The flow of cooling air 218 may be in communication with the first cooling chamber 208. That is, the flow of cooling air 218 may initially enter the first cooling chamber 208. The flow of cooling air 218 may then pass through the first impingement plate 212 via the holes 215. The first impingement plate 212 may be configured to create an increase in the velocity of the flow of cooling air 218 within the first cooling chamber 208. The increase in velocity increases the heat transfer coefficient within the first cooling chamber 208 and facilitates the cooling of the shroud assembly 200. The flow of cooling air 218 may then flow from the first cooling chamber 208 to the second cooling chamber 210 by way of the cooling channels 216. The flow of cooling air 218 passing through the cooling channels 216 may facilitate the cooling of the leading edge of the inner shroud portion 223 adjacent to the hot gas path 202. After entering the second cooling chamber 210, the flow of cooling air 218 may then pass through the second impingement plate 214 via the holes 215. The second impingement plate 214 may be configured to create an increase in the velocity of the flow of cooling air 218 within the second cooling chamber 210. The increase in velocity increases the heat transfer coefficient within the second cooling chamber 210 and facilitates the cooling of the shroud assembly 200.

In some instances, the first cooling chamber 208 may include one or more cooling passages 220 configured to discharge at least a portion of the flow of cooling air 218 into a hot gas path 202 near the leading edge of the blade 204. In other instances, the second cooling chamber 210 may include one or more exit passages 222 configured to discharge the flow of cooling air 218 from the second cooling chamber into a hot gas path 202 near a trailing edge of the blade 204.

Figure 3:
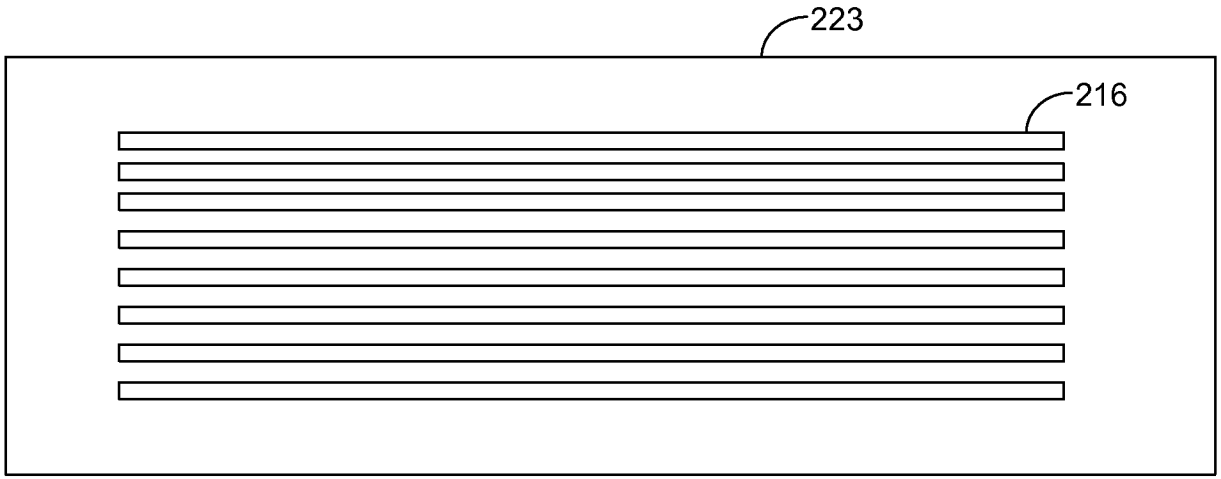
FIG. 3 is an example schematic view of one or more cooling channels formed within the shroud structure, according to an embodiment of the disclosure.

FIG. 3 depicts a schematic view of the inner portion 223 of the shroud assembly 200. As noted above, the inner portion 223 of the shroud assembly 200 may include a number of cooling channels 216 formed therein. The cooling channels

216 may be any depth and/or any length to enable the passage of cooling air 218 from the first cooling chamber 208 to the second cooling chamber 210. For example, the cooling channels may extend the entire or partial length of the inner portion 223 of the shroud assembly 200. Further, the cooling channels 216 may be uniform or otherwise. In some instances, the cooling channels 216 may be positioned about the leading edge of the inner portion 223.

Figure 4:
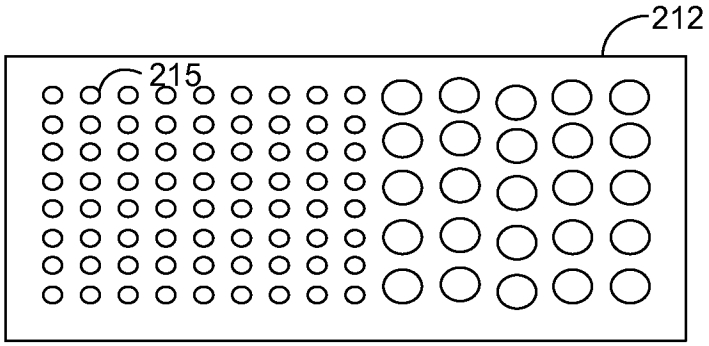
FIG. 4 is an example schematic view of an impingement plate, according to an embodiment of the disclosure.

FIG. 4 depicts a schematic view of the first impingement plate 212 of the shroud assembly 200. As noted above, the first impingement plate 212 may include a number of holes 215 therein. The holes 215 may be uniform or the holes 215 may vary in size. As depicted in FIG. 4, the holes 215 about the leading edge of first impingement plate 212 are smaller than the holes about the trailing edge of the first impingement plate 212. The holes 215 may be any configuration to optimize cooling of the shroud assembly 200. Similarly, the second impingement plate 214 may include a number of holes 215 therein. The configuration of the holes 215 in the first impingement plate 212 may be the same or different from the configuration of the holes 215 in the second impingement plate 214.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments.

That which is claimed:

1. A gas turbine shroud assembly for use with a flow of cooling air, comprising:

a shroud structure comprising a forward shroud wall, a rear shroud wall, a middle shroud wall, an outer shroud wall, and an inner shroud wall, wherein the forward shroud wall, the middle shroud wall, the outer shroud wall, and the inner shroud wall define a first cooling chamber, wherein the middle shroud wall, the rear shroud wall, and outer shroud wall, and the inner shroud wall define a second cooling chamber, wherein the inner shroud wall is disposed adjacent to a flow of hot combustion gases, and wherein the first cooling chamber is disposed upstream of the second cooling chamber relative to the flow of hot combustion gases;

a first impingement plate disposed within the first cooling chamber;

a second impingement plate disposed within the second cooling chamber; and plurality of cooling channels formed within the shroud structure, wherein the plurality of cooling channels comprise elongated grooves that extend axially within a surface of the inner shroud wall and connect the first cooling chamber with the second cooling chamber, wherein the flow of cooling air flows from the first cooling chamber to the second cooling chamber by way of the one or more cooling channels to cool a hotter portion of the inner shroud wall first.

2. The assembly of claim 1, wherein the first cooling chamber comprises one or more cooling passages configured to discharge at least a portion of the flow of cooling air into a hot gas path.

3. The assembly of claim 1, wherein the second cooling chamber comprises one or more exit passages configured to discharge the flow of cooling air into a hot gas path.

4. The assembly of claim 1, wherein the first and second impingement plates each comprise a plurality of holes therein.

5. The assembly of claim 4, wherein the plurality of holes comprise one or more variably sized holes.

6. The assembly of claim 1, wherein the second impingement plate is at least partially supported within the second cooling chamber by a radially extending support member.

7. The assembly of claim 1, wherein the first impingement plate is configured to create an increase in the velocity of the flow of cooling air in the first cooling chamber to increase the heat transfer coefficient within the first cooling chamber.

8. The assembly of claim 1, wherein the second impingement plate is configured to create an increase in the velocity of the flow of cooling air in the second cooling chamber to increase the heat transfer coefficient within the second cooling chamber.

9. A method, comprising:

flowing cooling air into a first cooling chamber defined within a shroud structure, comprising a forward shroud wall, a rear shroud wall, a middle shroud wall, an outer shroud wall, and an inner shroud wall, wherein the forward shroud wall, the middle shroud wall, the outer shroud wall, and the inner shroud wall define the first cooling chamber;

flowing the cooling air through a first impingement plate disposed within the first cooling chamber so as to create an increase in the velocity of the flow of cooling air to increase the heat transfer coefficient within the first cooling chamber;

flowing the cooling air through a plurality of axially extending cooling channels comprising elongated grooves formed within a surface of the inner shroud wall of the shroud structure to a second cooling chamber defined within the shroud structure, wherein the middle shroud wall, the rear shroud wall, and outer shroud wall, and the inner shroud wall define the second cooling chamber; and flowing the cooling air through a second impingement plate disposed within the second cooling chamber so as to create an increase the velocity of the flow of cooling air to increase the heat transfer coefficient within the second cooling chamber.

10. The method of claim 9, further comprising discharging at least a portion of the cooling air through one or more cooling passages associated with the first cooling chamber into a hot gas path.

11. The method of claim 9, further comprising discharging the cooling air through one or more exit passages associated with the second cooling chamber into a hot gas path.

12. A gas turbine assembly for use with a flow of cooling air, comprising:

a rotating blade assembly;

a shroud structure positioned about the rotating blade assembly, the shroud structure comprising a forward shroud wall, a rear shroud wall, a middle shroud wall, an outer shroud wall, and an inner shroud wall, wherein the forward shroud wall, the middle shroud wall, the outer shroud wall, and the inner shroud wall define a first cooling chamber, wherein the middle shroud wall, the rear shroud wall, and outer shroud wall, and the inner shroud wall define a second cooling chamber, wherein the inner shroud wall is disposed adjacent to a flow of hot combustion gases, and wherein the first cooling chamber is disposed upstream of the second cooling chamber relative to the flow of hot combustion gases;

a first impingement plate disposed within the first cooling chamber;

a second impingement plate disposed within the second cooling chamber; and a plurality of cooling channels formed within the shroud structure, wherein the plurality of cooling channels comprise elongated groove that extend axially within a surface of the inner shroud wall and are configured to connect the first cooling chamber with the second cooling chamber, wherein the flow of cooling air flows from the first cooling chamber to the second cooling chamber by way of the one or more cooling channels to cool a hotter portion of the inner shroud wall first.

13. The assembly of claim 12, wherein the first cooling chamber comprises one or more cooling passages configured to discharge at least a portion of the flow of cooling air into a hot gas path, and wherein the second cooling chamber comprises one or more exit passages configured to discharge the flow of cooling air into a hot gas path.

14. The assembly of claim 12, wherein the first and second impingement plates each comprise a plurality of holes therein.

15. The assembly of claim 14, wherein the plurality of holes comprise one or more variably sized holes.

16. The assembly of claim 12, wherein the second impingement plate is at least partially supported within the second cooling chamber by a radially extending support member.

17. The assembly of claim 12, wherein the first impingement plate is configured to create an increase in the velocity of the flow of cooling air in the first cooling chamber, and wherein the second impingement plate is configured to create an increase in the velocity of the flow of cooling air in the second cooling chamber.

* * * * *